US009995294B2

(12) United States Patent
Miguel et al.

(10) Patent No.: US 9,995,294 B2
(45) Date of Patent: Jun. 12, 2018

(54) HERMETIC RECIPROCATING COMPRESSOR FOR MOBILE APPLICATION PROVIDED WITH A MOVEMENT LIMITING ASSEMBLY

(71) Applicant: Whirlpool S.A., São Paulo-SP (BR)

(72) Inventors: Edson Correa Miguel, Joinville (BR); Patrick Getnerski, Joinville (BR)

(73) Assignee: Whirlpool S.A., Sao Paulo (BR)

( * ) Notice: Subject to any disclaimer, the term of this patent is extended or adjusted under 35 U.S.C. 154(b) by 159 days.

(21) Appl. No.: 14/909,393

(22) PCT Filed: Aug. 1, 2014

(86) PCT No.: PCT/BR2014/000262

§ 371 (c)(1),
(2) Date: Feb. 1, 2016

(87) PCT Pub. No.: WO2015/013794

PCT Pub. Date: Feb. 5, 2015

(65) Prior Publication Data

US 2016/0195080 A1 Jul. 7, 2016

(30) Foreign Application Priority Data

Aug. 1, 2013 (BR) ..... 102013019672

(51) Int. Cl.
*F04B 39/06* (2006.01)
*F04B 39/00* (2006.01)
(Continued)

(52) U.S. Cl.
CPC ..... *F04B 39/0044* (2013.01); *F04B 39/0027* (2013.01); *F04B 39/06* (2013.01);
(Continued)

(58) Field of Classification Search
CPC ..... F04B 35/045; F04B 39/0027; F25B 2400/073
See application file for complete search history.

(56) References Cited

U.S. PATENT DOCUMENTS 3,937,600 A * 2/1976 White ..... F04B 35/045 310/27
4,750,870 A * 6/1988 Curwen ..... F02B 71/00 417/340

(Continued)

FOREIGN PATENT DOCUMENTS

CN 101871445 A 10/2010
DE 102007052580 B3 7/2009

*Primary Examiner* — Patrick Hamo
(74) *Attorney, Agent, or Firm* — Harrington & Smith

(57) ABSTRACT

The present invention refers to a hermetic reciprocating compressor for mobile application provided with a movement limiting assembly of its compression unit in relation to its hermetic housing, comprising technical and functional characteristics capable of optimizing the limitation of the movement of the compression unit in relation to the hermetic housing of a hermetic reciprocating compressor, reducing at the same time the level and intensity of vibrations and noises arising from this movement limitation. Said hermetic reciprocating compressor for mobile application provided with a movement limiting assembly comprises, besides conventional elements and components, an upper end stop (4) attached to the inside upper portion of the hermetic housing (2), a housing body (5) attached to the compression unit (1) and comprising at least one housing cavity (51), and a damping structure (6) housed inside the housing cavity (51) of the housing body (5) comprising at least a surrounding wall (61) and at least a bottom plate (62).

5 Claims, 2 Drawing Sheets

(51) Int. Cl.
*F04B 39/12* (2006.01)
*F04B 53/14* (2006.01)

(52) U.S. Cl.
CPC ..... *F04B 39/121* (2013.01); *F04B 39/127* (2013.01); *F04B 53/14* (2013.01)

(56) References Cited

U.S. PATENT DOCUMENTS

| | | | | | |
|---|---|---|---|---|---|
| 5,395,218 | A * | 3/1995 | Thompson | F04B 27/005 | 417/416 |
| 5,537,820 | A * | 7/1996 | Beale | F01B 11/02 | 137/510 |
| 5,562,431 | A * | 10/1996 | Plummer | F04B 39/0027 | 137/512.15 |
| 6,790,015 | B1 * | 9/2004 | Song | F04B 35/045 | 417/415 |
| 2005/0201875 | A1 * | 9/2005 | Park | F04B 35/045 | 417/417 |

* cited by examiner

HERMETIC RECIPROCATING COMPRESSOR FOR MOBILE APPLICATION PROVIDED WITH A MOVEMENT LIMITING ASSEMBLY

FIELD OF THE INVENTION

The present invention refers to a hermetic reciprocating compressor for mobile application provided with a movement limiting assembly and, more particularly, provided with an assembly for limiting the movement of its compression unit in relation to its hermetic housing.

In general, the referred movement limiting assembly has technical and functional characteristics capable of optimizing the limiting of the movement of the compression unit in relation to the hermetic housing of a hermetic reciprocating compressor, reducing also the level and the intensity of vibrations and noises coming from this movement limiting.

BACKGROUND OF THE INVENTION

As it is known by the technicians skilled in the art, hermetic reciprocating compressors comprise equipment capable to compress a certain work fluid. Normally applied in refrigeration systems, the hermetic reciprocating compressors are, therefore, capable of compressing any refrigerating fluid.

In general, hermetic reciprocating compressors are composed by a compression unit enclosed in a hermetic housing.

The compression unit comprises all the functional set of the compressor, that is, the compressor block, the array head-cylinder-piston and the compressor engine. A hermetic housing, as defined by nomenclature itself comprises a receptacle, its inside volume free from hard contact with the inside environment, able to house inside it the referred compression unit.

Conventionally, and as it is known to the technicians skilled in the art, the compression unit is enclosed in the hermetic housing in a semi flexible way, that is, through suspension systems and especially pipes that allow, up to a certain point, the mobility of the compression unit inside the hermetic housing.

Moreover, the state of the art comprises a vast variety of models and variations of suspension systems used to support the mobile unit inside the hermetic housing of the hermetic reciprocating compressor.

The prior art document U.S. Pat. No. 4,174,189 discloses a suspension system including a shipping stop arrangement for resiliently mounting a refrigeration motor-compressor unit within a hermetically sealed shell The document US2005201875 discloses a linear compressor having a dynamic vibration-reducing unit, which is provided at a stopper, by which separation of a cylinder block is prevented, for eliminating vibration generated from a hermetically sealed container at a specific frequency band.

Another embodiment may be seen at document GB923759, wherein a resilient support of an electric motor compressor unit mounted vertically within an hermetically sealed outer casing, said motor been affected firstly by a coil spring extending between the bottom of casing and a recess.

Finally the document GB875547 discloses a hermetically sealed compressor comprising a motor-compressor unit resiliently mounted within a casing, and the weight of the unit is normally taken by a spring mounted within a ringed cup and located with respect to the unit by a pin welded thereon.

The current models of suspension systems used to support a mobile unit inside the hermetic housing of a hermetic reciprocating compressor allow, therefore, that the mobile unit eventually contacts the internal face of the hermetic housing.

This happens mainly with hermetic reciprocating compressor for mobile applications such as, for example, with hermetic reciprocating compressors used in refrigeration systems of automotive vehicles. This is because the movement of the automotive vehicle applies dynamic forces on the compression unit, which tends to move inside the hermetic housing.

As it has already been mentioned, it cam be considered as common the occurrence of shocks between the compression unit and the inside wall of the hermetic housing. Such shocks, depending on its intensity may in the end damage and undermine certain components of the compression unit. This characteristic, by itself alone, is extremely negative.

Aiming at the solution of this problem, one can observe the existence of certain sets to limit the movement of the compression unit.

DE102007052580 describes, for example, a movement limiting set constituted essentially of an end stop attached to the inside upper portion of the hermetic housing and a body to house the end stop attached to the compression unit.

More specifically, DE102007052580 describer that the body for the end stop housing is attached to the compression unit through screws that attach the cover of the head to the compressor block and comprises a perforated region (or opening) to house the end stop of the housing.

Since the perforated region has dimensions that are greater than the dimensions of the end stop, there can be observed a kind of mechanical gap between them. Therefore, the free movement of the compression unit, inside the hermetic housing, is reduced to the mechanical gap existing between the perforated region of the body of the housing and the end stop of the hermetic housing.

Therefore, the movements of the compression unit, if they are greater that the mechanical gap between the perforated region of the hermetic housing and the end stop of the hermetic housing, they are limited by the physical contact between the end stop of the hermetic housing and the housing body of the compression unit.

Though it is theoretically interesting, the movement limiting set described in DE102007052580 presents, two great drawbacks.

The first drawback is related to the rattling and/or noises generated by the physical contact between the end stop of the hermetic housing and the housing body of the compression unit. Since both the components are hard (and usually metallic), each contact between them generates an undesirable noise its amplitude varying depending on the energy of the physical contact. Thus, the stronger the physical contact between the end stop of the hermetic housing and the housing body of the compression unit, the greater is the amplitude of the rattling and/or noise.

This negative aspect is increased in hermetic reciprocating compressors for mobile application, where the movement of the compression unit inside the hermetic housing is predominantly greater and stronger.

The second negative aspect is the range of movement limitation that the movement limiting set described in DE102007052580 is capable of providing to the compression unit.

As it is possible to verify, the movement limiting set mentioned described in DE102007052580 is capable to work in only one dimensional direction of the movement of the compression unit, that is, only in the horizontal direction of the compression unit.

Consequently, any vertical movement of the compression unit inside the hermetic housing is not limited by the movement limiting set. Thus, only part of the three-dimensional movements of the compression unit is limited and there is no way of preventing the contact (shock) of the compression unit with the other portions of the hermetic housing.

This negative aspect is also increased in hermetic reciprocating compressors for mobile application where the movement of the compression unit inside the hermetic housing is predominantly three-dimensional.

With the solution of these negative aspects in view, the current state of the art further comprises the movement limiting set described in CN101871445.

As it happens with the movement limiting set described in DE102007052580, the movement limiting set described in CN101871445 is essentially aimed at hermetic reciprocating compressors and is essentially composed by an end stop attached to the inside upper portion of the hermetic housing, and a housing body of the end stop attached to the compression unit. There is further provided a connection spring between the referred end stop and the said housing body of the end stop.

Moreover, there is further mentioned that the perforated region of the housing body of the end stop intended to house the end stop of the housing may accept a damping ring made from a resilient material (using, preferably, a polymeric alloy).

Thus, the movement limiting set described in CN101871445 is, theoretically, able to reduce the two great negative aspects existing in the movement limiting set described in DE102007052580.

This happens because the damping ring is, theoretically, able do reduce the rattling and or noises arising from the physical contact between the end stop of the hermetic housing and the housing body of the compression unit.

Moreover, the spring connecting the end stop and the housing body of the end stop is also, theoretically, able to restrict and or limit the vertical movements the compression unit may perform inside the hermetic housing, preventing, at the same time, the end stop from displacing the housing body.

However, the movement limiting set described in CN101871445 has its own negative aspects.

As it can be observed, the addition of a connection spring means, just by itself, a negative aspect from the economical and technical point of view.

From the economical point of view, the addition of a connection spring means manufacturing and mounting of an additional component, said manufacturing and mounting involving additional costs capable of raising the costs of the making of the compressor. Furthermore, the addition of this additional component, however small, increases the total weight of the compressor, which may increase the costs of the transportation.

From the technical point of view, employing the connection spring as an element for the limitation of the vertical movement of the compression unit, in relation to the hermetic housing, is only effective in the short run, for the extended use of the said spring, mainly in mobile applications, reduces its resilient elastic characteristic, resulting in the reduction of its performance.

Therefore, with the view of solving of problems related to the movement limiting set described in DE102007052580, in a different way from the solution described in CN101871445, there arose the present invention.

OBJECTIVES OF THE INVENTION

Therefore, faced with the context exposed above, one of the objectives of the present invention is to describe a hermetic reciprocating compressor for mobile application provided with the movement limiting set the movement limiting set lacking any kind of connection spring and able to limit the three-dimensional movement of the compression unit in relation to the hermetic housing.

Consequently, one of the objectives of the present invention is to describe a hermetic reciprocating compressor for mobile application provided with a movement limiting assembly, said movement limiting assembly being of simple making and mounting, and provided with a long lifetime.

Another objective of the present invention is to make the referred movement limiting assembly of the hermetic reciprocating compressor for mobile application to be able to absorb noises and vibrations arising from the physical contact between the end stop and the housing body.

SUMMARY OF THE INVENTION

Given this and aiming at reaching the technical objectives and effects indicated above, the present invention discloses a hermetic reciprocating compressor for mobile application provided with a movement limiting assembly. The compressor comprises, essentially, at least one compression unit disposed to be able to move inside a hermetic housing, at least one lower suspension system between the compression unit and the hermetic housing and at least one movement limiting assembly consisting of at least one upper end stop and at least one housing body.

According to the present invention, the upper end stop is attached to the inside upper portion of the hermetic housing and the housing body is attached to the compression unit, and comprising at least a housing cavity.

Still according to the present invention, the hermetic reciprocating compressor for mobile application provided with the movement limiting assembly comprises at least a damping structure housed inside the housing cavity of the housing body. In this context, the upper end stop is housed, substantially in a floating way, inside the damping structure.

Said damping structure, comprising the great novel aspect of the present invention, comprises at least a surrounding wall and at least a bottom plate, the surrounding wall projecting from the bottom plate, which has a circular outline.

Preferably, the housing cavity of the housing body comprises a surrounding wall and a bottom plate.

Also preferably, the damping structure is manufactured from fluoropolymer elastomer.

In general, according to the present invention, the surrounding wall of the damping structure defines the course of the horizontal movement of the compression unit inside the hermetic housing and the bottom plate of the damping structure defines the course of the vertical upper movement of the compression unit inside the hermetic housing.

BRIEF DESCRIPTION OF THE FIGURES

The present invention will be described below in a more detailed way, referring to the annexed figures, wherein.

DETAILED DESCRIPTION OF THE INVENTION

According to what has already been mentioned, there are many reasons for the application of a movement limiting assembly in hermetic reciprocating compressors and, especially, in hermetic reciprocating compressor for mobile application such as, for example, refrigeration systems in automotive vehicles.

Thus, the main objective of the present invention is to describe a hermetic reciprocating compressor for mobile application provided with a movement limiting assembly, said movement limiting assembly being technically more advantageous than the similar assembly described in DE102007052580 and economically and technically more effective than the similar assembly described in CN101871445.

Figure 2:
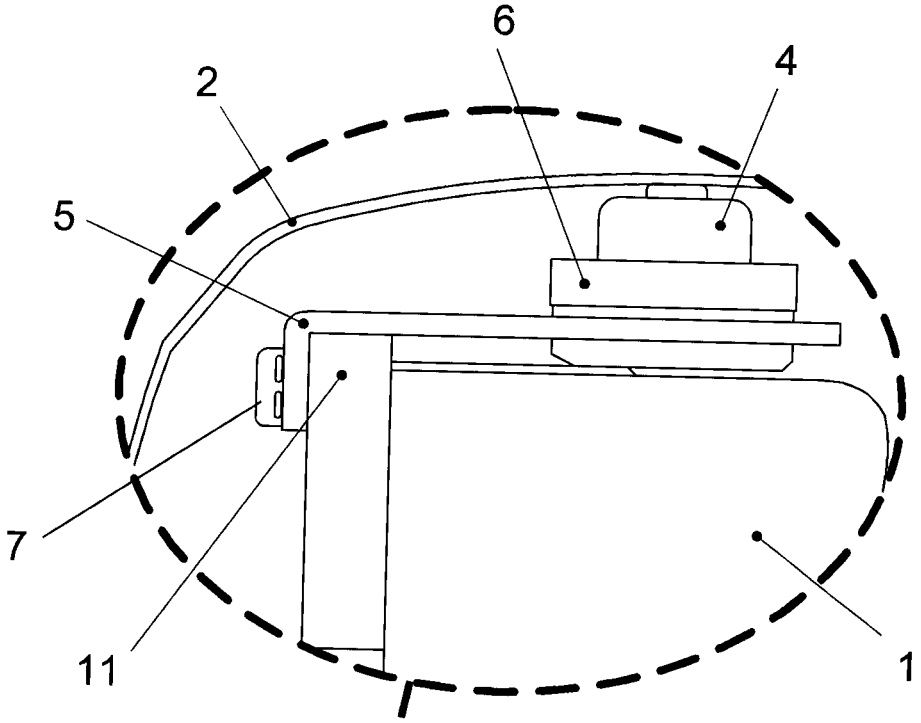
FIG. 2 shows and enlarged detail taken from FIG. 1.
Figure 1:
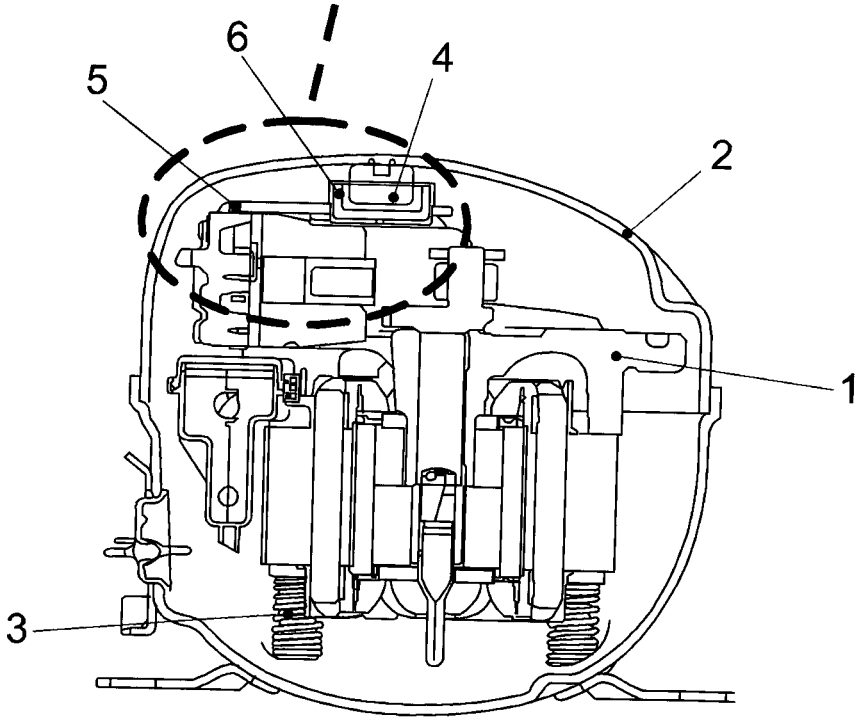
FIG. 1 shows schematically in a lateral section an example of the hermetic reciprocating compressor for mobile application provided with a movement limiting assembly, according to the present invention.

According to the illustrations on FIGS. 1 and 2, which illustrate a schematic embodiment of the compressor according to the innovations and advantages of the present invention, the hermetic reciprocating compressor for mobile application is essentially comprised by a compression unit 1 and a hermetic housing 2.

As it is known by the technicians skilled in the art, the conventional compression unit of a hermetic reciprocating compressor for mobile or stationary application is essentially composed by an electric engine, by a compressor block and by a group of piston-connecting rod-eccentric shaft and an array of head-valves.

In general, the compression unit 1 illustrated is a conventional compression unit well known by the technicians skilled in the art, and has been widely described and studied in the specialized literature. Consequently, the compression unit 1 of the hermetic reciprocating compressor does not constitute the object of the present invention, but eventually defines its technological field.

As it is further known by the technicians skilled in the art, the conventional hermetic housing of a hermetic reciprocating compressor for mobile or stationary application is essentially composed by two bodies capable of being physically associated between them, defining a hermetic volume or chamber.

In general, the hermetic housing 2 illustrated is a conventional hermetic housing well known by the technicians skilled in the art, and widely described and studied in the specialized literature. Consequently, the hermetic housing 2 of the hermetic reciprocating compressor does not constitute the object of the present invention, but eventually defines its technological field.

Moreover, it is worth stressing that there are also provided lower suspension systems 3 disposed between the compression unit 1 and the hermetic housing 2. Such suspension systems 3 are also well known by the technicians skilled in the art and do not constitute, for all purposes, the object of the present invention, constituting just another one of the fundamental elements that constitute a hermetic reciprocating compressor.

Just as a commentary, one can stress the fact that the lower suspension system 3 of hermetic reciprocating compressors for mobile application are especially manufactured in a way that makes the outside vibrations flow into the hermetic housing.

According to what is better illustrated in FIG. 2, the movement limiting assembly of the hermetic reciprocating compressor comprises an upper end stop 4, housing body 5.

The upper end stop 4 consists, preferably, in a metallic block capable to be attached to the inside upper portion of the hermetic housing 2, preferably through welding. However the upper end stop 4, according to the present invention, may be attached to the inside upper portion of the hermetic housing 2 through any other means of attachment known by technicians skilled in the art, such as, for example, by screwing and others.

The housing body 5 comprises, preferably, a metallic frame defining a housing cavity 51, an extender portion 52 and attachment ends 53.

Figure 3:
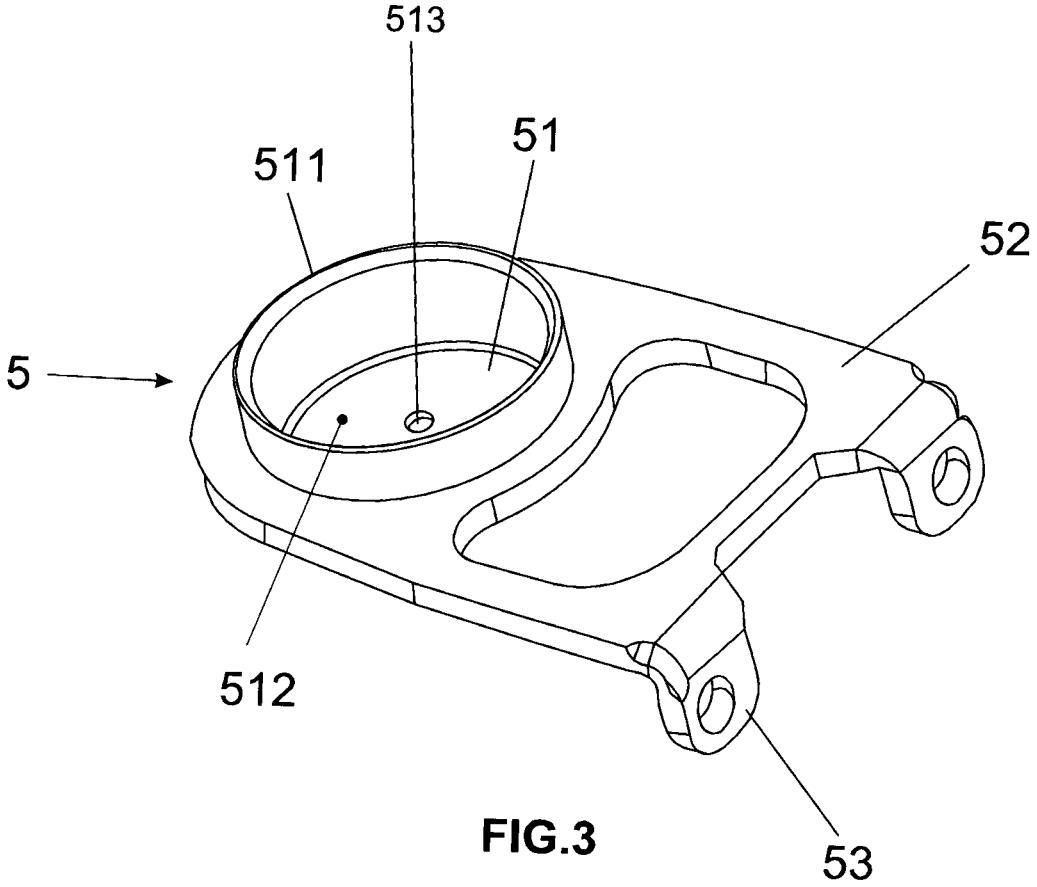
FIG. 3 show, in isometric perspective the preferred embodiment of the housing body part of the movement limiting assembly.

The housing cavity 51, as better illustrated in FIG. 3 comprises a surrounding wall 511 and a bottom plate 512, both of the having a circular outline.

In said bottom plate 512 of the housing cavity 51 there is provided a equalizing orifice 513 with the function of keeping in balance the pressure inside the housing cavity 51 and the environment of the hermetic housing of the compressor and, more particularly, of the compressor at the time the compressor is in an evacuation process, assuring the correct coupling of the damping structure 6.

The extender portion 52 projects from the housing cavity 51 and up to the attachment ends 53, which consist simply in projections provided with through holes for the housing of the attachment means 7.

The attachment ends 53 define ultimately the setting angle of the housing body 5, which may range from −1 degree to −2 degrees considered on the extender portion 52. Such angulation aims at assuring the setting of the housing body 5 in the block cast from the compression unit 1. This is necessary to prevent the rebound of the housing body 5, and problems of noise and vibration.

To this end, and according to what is illustrated in FIG. 2, the housing body 5 is attached together with the cover of the head 11 (from the array of valve-heads of the compression unit 1) to the compression unit 1 through means of attachment 7 that go through its attachment ends 53.

The characteristics described up to now, with the exception of certain specific and not essential details of the housing body 5, may also be checked in DE102007052580 and CN101871445.

However, the hermetic reciprocating compressor for mobile application provided with a movement limiting assembly, according to the present invention, is also constituted by a damping structure 6, which is not provided in said DE102007052580 and CN101871445.

Figure 4:
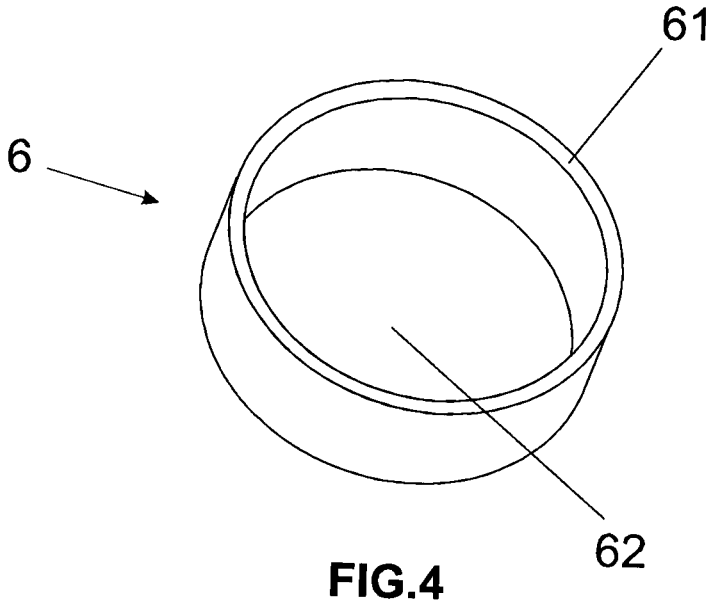
FIG. 4 shows, in isometric perspective, the preferred embodiment of the damping structure part of the movement limiting assembly.

According to what is better illustrated in FIGS. 2, 4 and 5, the damping structure 6 is housed inside the housing cavity 51 of the housing body 5, and contains at least one surrounding wall 61 and at least one bottom plane 62. Preferably, said damping structure 6 is manufactured from a fluoropolymer elastomer.

In its preferred embodiment, the damping structure 6 presents dimensions similar to the dimensions of the housing cavity 51 of the housing body 5, both its surrounding wall 61 and its bottom plate 62 presenting a circular forma.

Still according to this preferred embodiment, said surrounding wall 61 projects from the bottom plate 62.

Since the damping structure 6 is housed inside the housing cavity 51 of the housing body 5, it is possible to assess that, in contrast to what is provided by the current state of the art, the upper end stop 4 is housed, in a way substantially floating, inside said damping structure 6 (instead of being housed in its own housing body).

This embodiment, just by itself, already inhibits any possibility of physical contact between said upper end stop 4 and the housing body 5.

Therefore, it is the damping structure 6 itself that limits the movement of the compression unit 1 in relation to the hermetic housing 2, all the movement of the compression unit 1 is reflected finally in a movement of the housing body 5 and the damping structure 6, only this one contacting physically with the upper end stop 4 attached to the hermetic housing 2.

In this way, it is possible to employ a hard component (housing body 5) for the attachment on the compression unit 1, and a flexible component (damping structure 6) do contact with the upper end stop 4.

Consequently, the damping structure 6 acts finally as the component that absorbs the vibrations and noises when there is a shock between the mobile components and the stationary components of the hermetic reciprocating compressor.

In addition, and due to the fact that the damping structure 6 is constituted by a surrounding wall 61 and a bottom plate 62, it happens that said surrounding wall 61 finally defines the course of the horizontal movement of the compression unit 1 inside the hermetic housing, and said bottom plate 62 finally defines the course of the upper vertical movement of the compression unit 1 inside the hermetic housing 2.

Thus, the bottom plate 62 of the damping structure 6 finally substitutes with more effectiveness the spring existing in the set described in CN101871445.

This happens because said bottom plate 62 of the damping structure 6 acts like an end of course in relation to the upper end stop 4, defining a limit of the upper movement of the compression unit 1 inside the hermetic housing 2.

According to the present invention, the limitation of lower movement of the compression unit 1 inside the hermetic housing 2 may be defined by the lower to suspension systems 3.

The invention claimed is:

1. Hermetic reciprocating compressor for a mobile application provided with a movement limiting assembly, comprising:

at least one compression unit movably disposed inside a hermetic housing;

at least one lower suspension system between the compression unit and the hermetic housing;

at least one movement limiting assembly constituted by at least one upper end stop and at least one housing body;

the upper end stop being attached to the inside upper portion of the hermetic housing;

the housing body being attached to the compression unit and comprising at least a housing cavity;

wherein:

the housing cavity further provides an equalizing orifice;

at least one damping structure housed inside the housing cavity of the housing body is further provided;

said damping structure comprising at least a damping surrounding wall and at least one damping bottom plate in that the damping surrounding wall is a projection from the damping bottom plate;

the housing cavity comprising a cavity surrounding wall and a cavity bottom plate; and the equalizing orifice is disposed on the cavity bottom plate of the housing cavity.

2. Compressor, according to claim 1, CHARACTERIZED in that the bottom plate has a circular outline.

3. Compressor, according to claim 1, CHARACTERIZED in that the upper end stop is housed, in a floating way, inside the damping structure.

4. Compressor, according to claim 1, CHARACTERIZED in that the damping structure is manufactured from a fluoropolymer elastomer.

5. Compressor, according to claim 1, CHARACTERIZED in that the surrounding wall of the damping structure defines a course of the horizontal movement of the compression unit inside the hermetic housing; the bottom plate of the damping structure defines a course of the upper vertical movement of the compression unit inside the hermetic housing.

* * * * *